United States Patent [19]

Wasco, Jr.

[11] 3,939,609

[45] Feb. 24, 1976

[54] GRINDING MACHINE CONSTRUCTION

[75] Inventor: Anthony Wasco, Jr., Saginaw, Mich.

[73] Assignee: The Wickes Corporation, San Diego, Calif.

[22] Filed: Apr. 4, 1974

[21] Appl. No.: 457,774

[52] U.S. Cl. ..... 51/5 D; 51/165.87

[51] Int. Cl.[2] ..... B24B 49/18

[58] Field of Search ..... 51/2 C, 2 D, 2 F, 2 H, 51/2 J, 5 D, 34 E, 125, 131, 165.87, 165.88, 165.79

[56] References Cited

UNITED STATES PATENTS

| | | | |
|---|---|---|---|
| 2,658,313 | 11/1953 | Bowen | 51/165.89 X |
| 2,882,651 | 4/1959 | Price | 51/165.87 X |
| 2,894,360 | 7/1959 | Alvord | 51/165.87 |
| 3,157,969 | 11/1964 | Fant | 51/165.87 |
| 3,339,317 | 9/1967 | Cleland | 51/5 D X |
| 3,577,685 | 5/1971 | Corbex | 51/165.89 |
| 3,640,024 | 2/1972 | Stahn | 51/165.87 |
| 3,791,084 | 2/1974 | Kakumu | 51/165.87 |
| 3,818,643 | 6/1974 | Pagella | 51/165.87 X |
| 3,824,743 | 7/1974 | Price | 51/165.87 X |

*Primary Examiner*—Donald G. Kelly
*Attorney, Agent, or Firm*—Learman & McCulloch

[57] ABSTRACT

A grinding machine for grinding surfaces of workpieces supported on a frame comprises a first slide mounted on the frame for reciprocating movements along a fixed length path toward and away from the workpieces, the first slide supporting a second slide which carries grinding wheels. The second slide is adjustably mounted on the first slide for movements with the latter so as to effect movement of the grinding wheels into and out of engagement with the workpieces and for movements relative to the frst slide so as to compensate for erosion of the grinding wheels caused by grinding or dressing operations. The machine includes dressing tools for the grinding wheels and which are operable in timed relation to the reciprocating movements of the slides to effect dressing of the grinding wheels.

19 Claims, 9 Drawing Figures

7
100
99
98
94
93
84
95
96
110
91
90
87
92
108
109
89
85
41
124
107
105
106
42
40
44
113
112
45
43
46
116
111
a
113
47
115
33
34
32
35
28
29
20
27
14
23
25
22
21
27
28
29
30
36
35
32
31

GRINDING MACHINE CONSTRUCTION

The invention disclosed herein relates to a machine tool such as a grinding machine that is especially adapted for the precision grinding of workpieces and which automatically compensates for erosion or wear of the grinding wheels due to grinding operations and dressing of the wheels.

An automatic grinding machine capable of high production and precision grinding operation should embody such characteristics as rapid travel speeds toward and away from a workpiece prior to and following the grinding operation, respectively, and a rigidly controlled rate of feed of the grinding wheel to the workpiece during the grinding operation. The rate of feed of the grinding wheel to the workpiece should be adjustable so as to enable the machine to be adaptable to the grinding of many different kinds of workpieces. In addition, such a machine should be capable of use with different kinds of griding wheels composed of materials having differing degrees of hardness, and still be capable of automatically compensating for erosion of the materials of such wheels.

Automatic grinding machinery also should be easily adjustable for the grinding of different kinds of workpieces and should have its various movements easily synchronized and in such a manner as to avoid inadvertent unsynchronization. Moreover, automatic grinding machinery should have means for indicating the necessity of changing a worn grinding wheel and be capable of effecting substitution of worn wheels with fresh wheels without the necessity of having to undertake laborious and time-consuming set-up operations each time worn wheels must be replaced.

Various kinds of automatic or semi-automatic grinding machines have been proposed, and most, if not all, of them are operated hydraulically. One of the major disadvantages of hydraulically operated grinding machines is that the operating characteristics of such machines vary in accordance with fluctuations in hydraulic pressures. Moreover, variations in the viscosity of hydraulic fluid because of temperature changes also adversely affect operation of such grinding machines. In those machines which depend fully upon hydraulic operating mechanisms, or partly upon hydraulic mechanisms and cam mechanisms, it is extremely difficult to maintain synchronization of the movable parts of the machines. Such difficulty is encountered because of pressure and viscosity changes affecting the hydraulic fluid.

An object of this invention is to provide an automatic grinding machine which overcomes the disadvantages of the previously known machines for similar purposes.

Another object of the invention is to provide an automatic grinding machine wherein the approach of a grinding wheel, the feed of the grinding wheel to the workpiece, the dressing of the grinding wheel, and the withdrawal of the grinding wheel from the workpiece are fully and automatically synchronized.

A further object of the invention is to provide a grinding machine of the character described and in which erosion of the grinding wheel due to grinding and dressing operations is compensated for automatically.

Other objects and advantages of the invention will be pointed out specifically or will become apparent from the following description when it is considered in conjunction with the appended claims and the accompanying drawings, in which:

Figure 1:
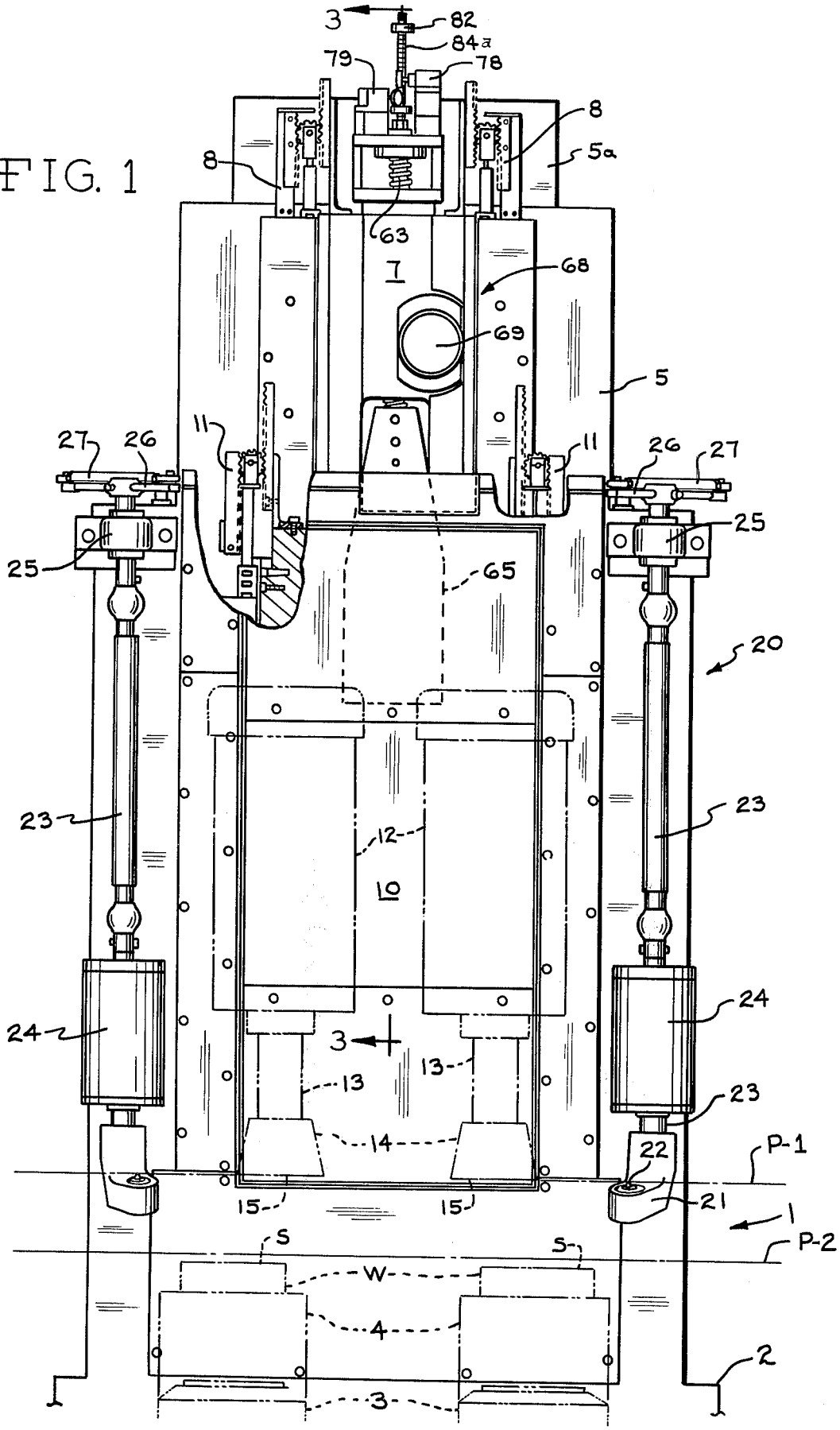
FIG. 1 is a fragmentary, front elevational view of a grinding machine constructed in accordance with the invention, the workpiece supporting means and the grinding apparatus being shown in phantom lines for purposes of clarity.

A grinding machine constructed in accordance with the disclosed embodiment of the invention comprises a frame 1 having a base 2 in which is journaled a pair of spaced apart spindles 3 that are adapted to be rotated by electric motors (not shown). Each spindle is fitted with a workpiece supporting chuck 4 of conventional construction, each of which is adapted to support a workpiece W having an upper surface S which is to be ground. The frame 1 also includes an upstanding head or block 5 which is supported on the base 2, and spanning the upper end of the block is a header 5*a*.

Figure 2:
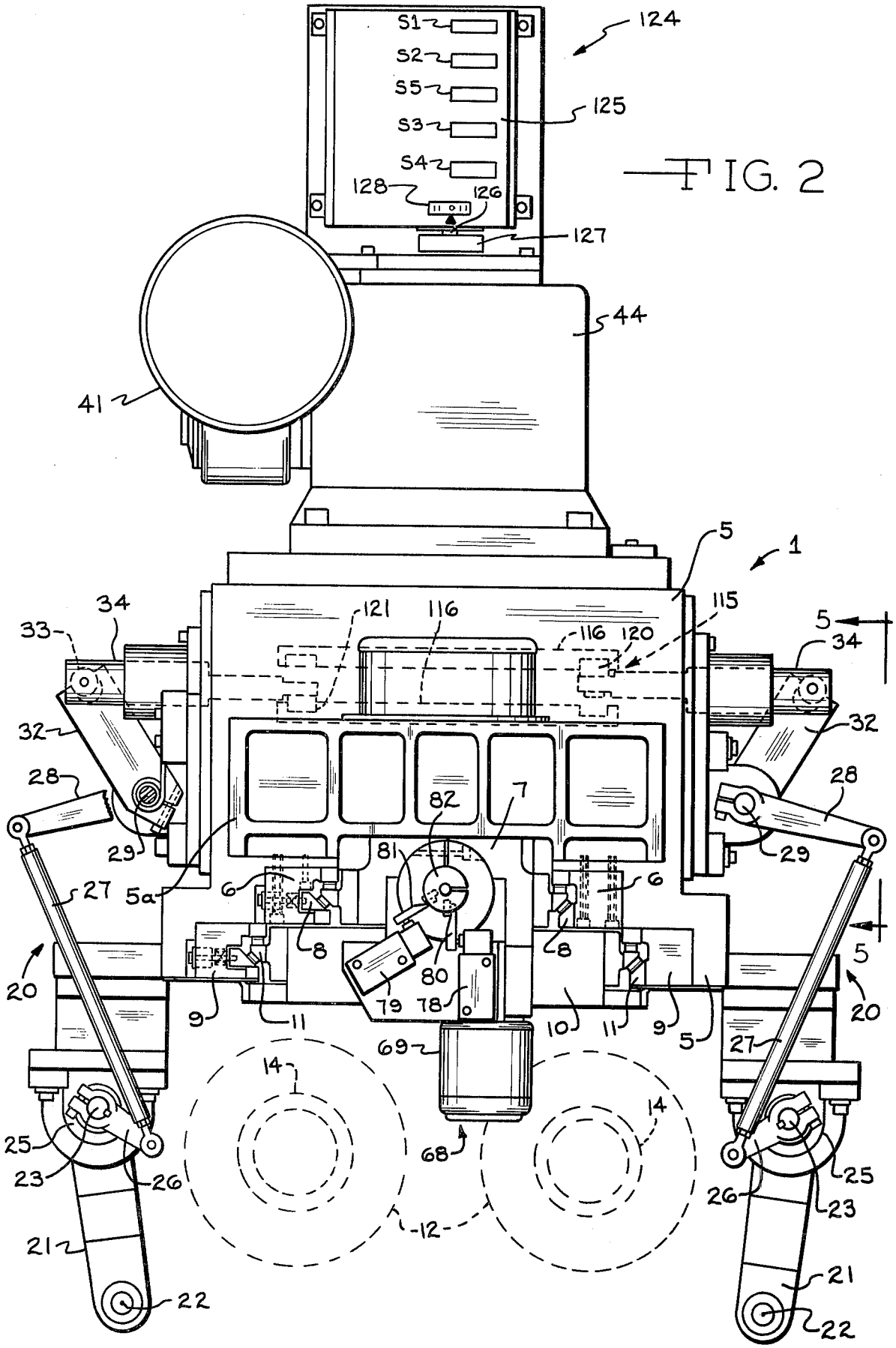
FIG. 2 is a top plan view of the apparatus shown in FIG. 1.

As is best shown in FIG. 2, the front face of the block 5 is provided with ways 6 between which is accommodated a main or first slide 7 guided for vertical reciprocating movements by bearing assemblies 8. The block 5 also is provided with ways 9 between which a compensator or second slide 10 is guided for vertical reciprocating movements by bearing assemblies 11. The compensator slide 10 partially overlies the main slide 7 and has bolted or otherwise suitably secured to its front surface a pair of electric motors 12 within which are journaled rotatable spindles 13 to the free ends of which are removably secured tools such as grinding wheels 14 of conventional construction. The grinding wheels 14 are so oriented on the slide 10 that their lower surfaces 15 overlie and are engageable with the surfaces S of the workpieces W.

Figures 4, 5, 6, 7:
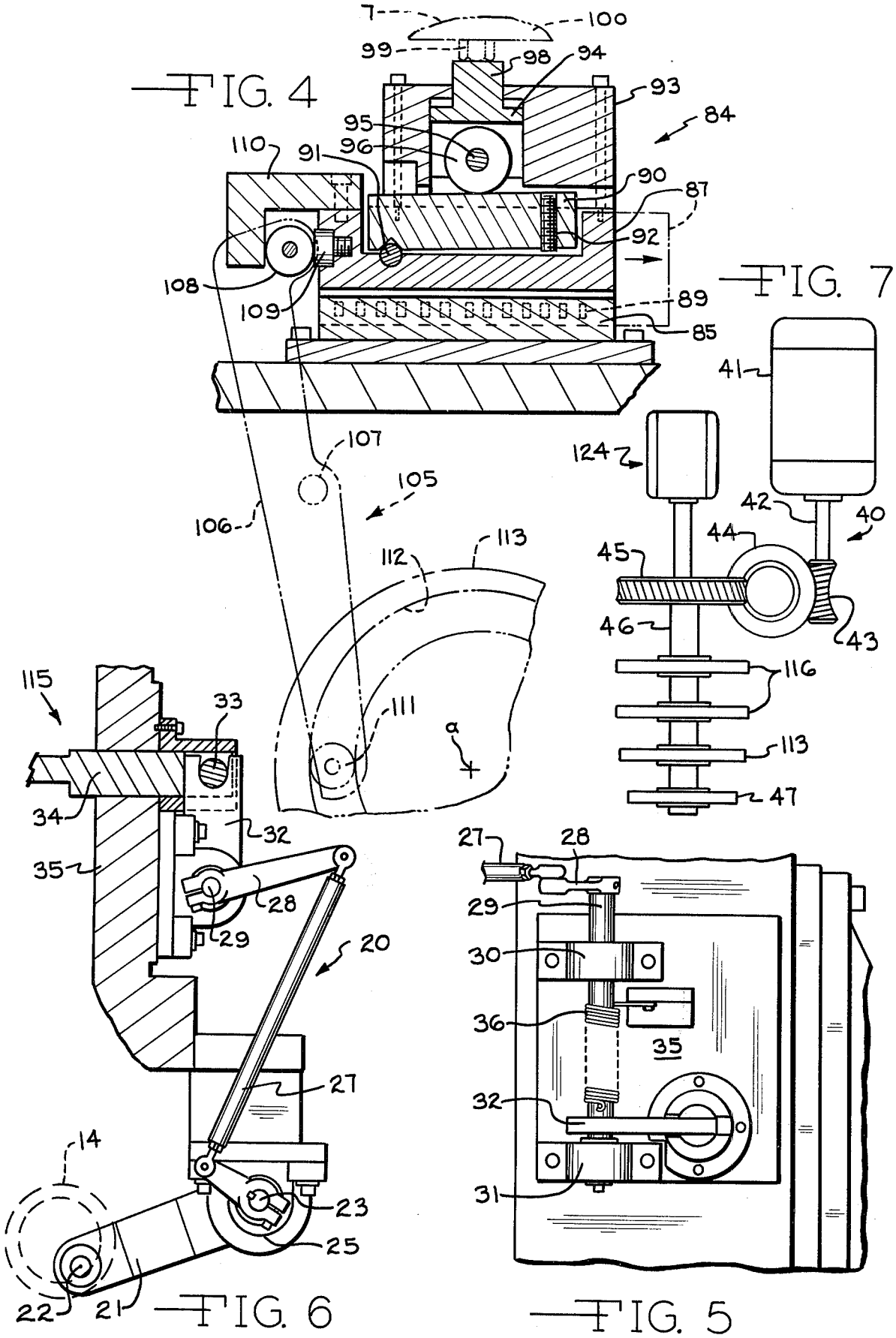
FIG. 4 is an enlarged, sectional view taken on the line 4—4 of FIG. 3.
FIG. 5 is a fragmentary view of a portion of the apparatus as viewed along the lines 5—5 of FIG. 2.
FIG. 6 is a plan view of a portion of the apparatus shown in FIG. 2, certain parts being shown in section.
FIG. 7 is a diagrammatic view of driving and control apparatus according to the invention.

A pair of grinding wheel dressing assemblies 20 is mounted at opposite sides of the block 5 for the purpose of effecting dressing of the surfaces 15 of the grinding wheels 14. Each dresser assembly includes a substantially L-shaped holder 21 at the free end of which is fixed an upstanding dressing tool 22. The opposite end of each holder 21 is fixed to a rotary arm 23 which is journaled adjacent its lower end in a bearing assembly 24 and at its upper end in a bearing assembly 25, the assemblies 24 and 25 being fixed to the block 5. To the upper end of each rod 23 is fixed one end of a crank arm 26, the opposite end of which is pivoted to one end of a link 27. The other end of the link 27 is pivoted to one end of an arm 28, the opposite end of which is fixed to a rock shaft 29 that is journaled adjacent its opposite ends in bearing houses 30 and 31 (FIG. 5).

To each rock shaft 29 is fixed one end of a crank arm 32 the opposite end of which is notched to receive a pin 33 carried by a reciprocable arm 34 which slidably extends through an opening in a wall portion 35 of the block 5. Reciprocating movements of the arms 34 in a manner subsequently to be described will effect swinging movements of each of the dressing tool holders 21 from a retracted position as shown in FIG. 2 to a wheel dressing position as shown in FIG. 6, and return.

A torsion spring 36 (FIG. 5) encircling each of the rock shafts 29 exerts a force on the latter urging the tool holders 21 toward the retracted positions shown in FIG. 2.

Figure 3:
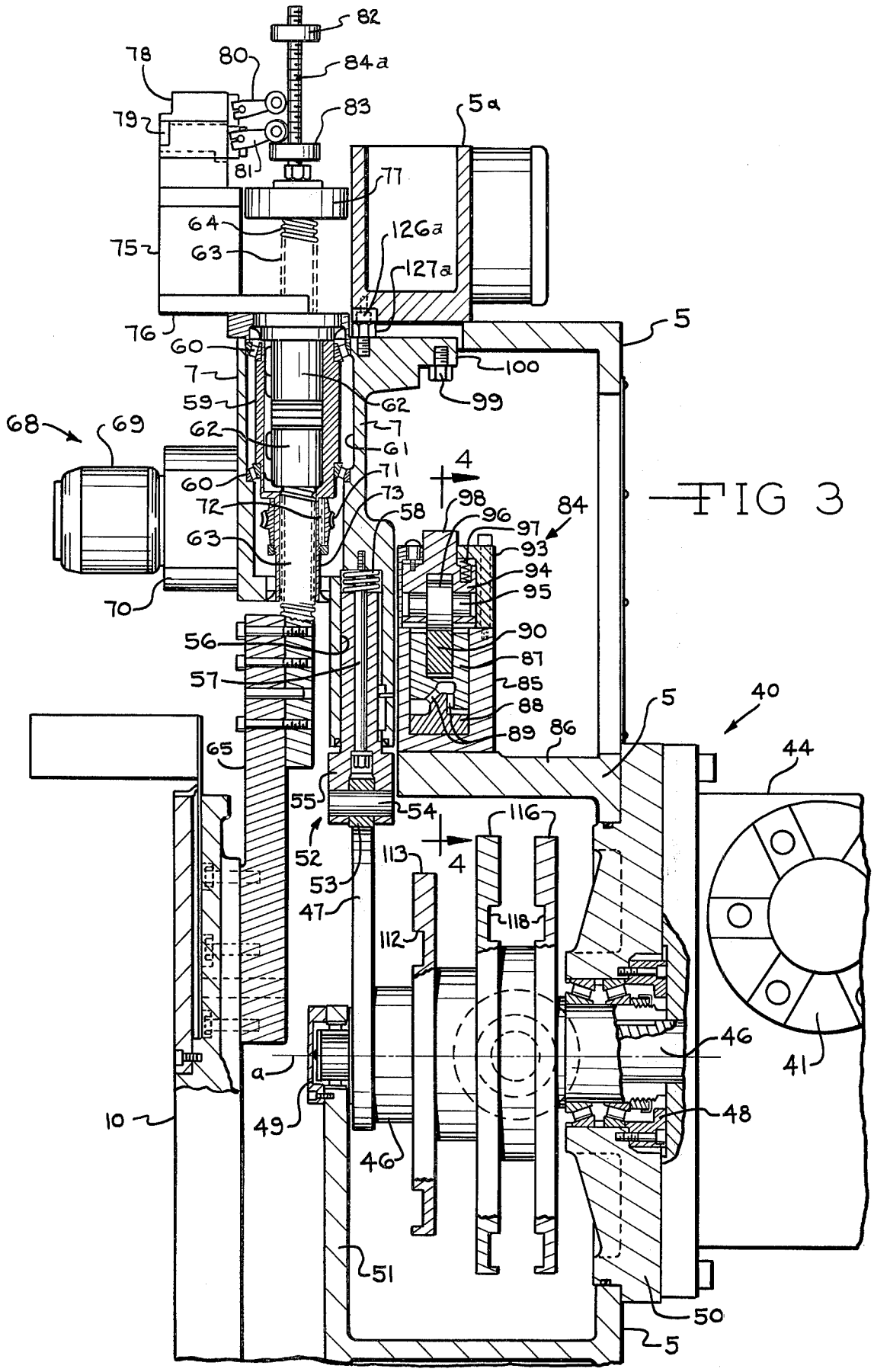
FIG. 3 is an enlarged, sectional view on the line 3—3 of FIG. 1 and illustrating the parts of the apparatus in one position of adjustment.
Figure 3A:
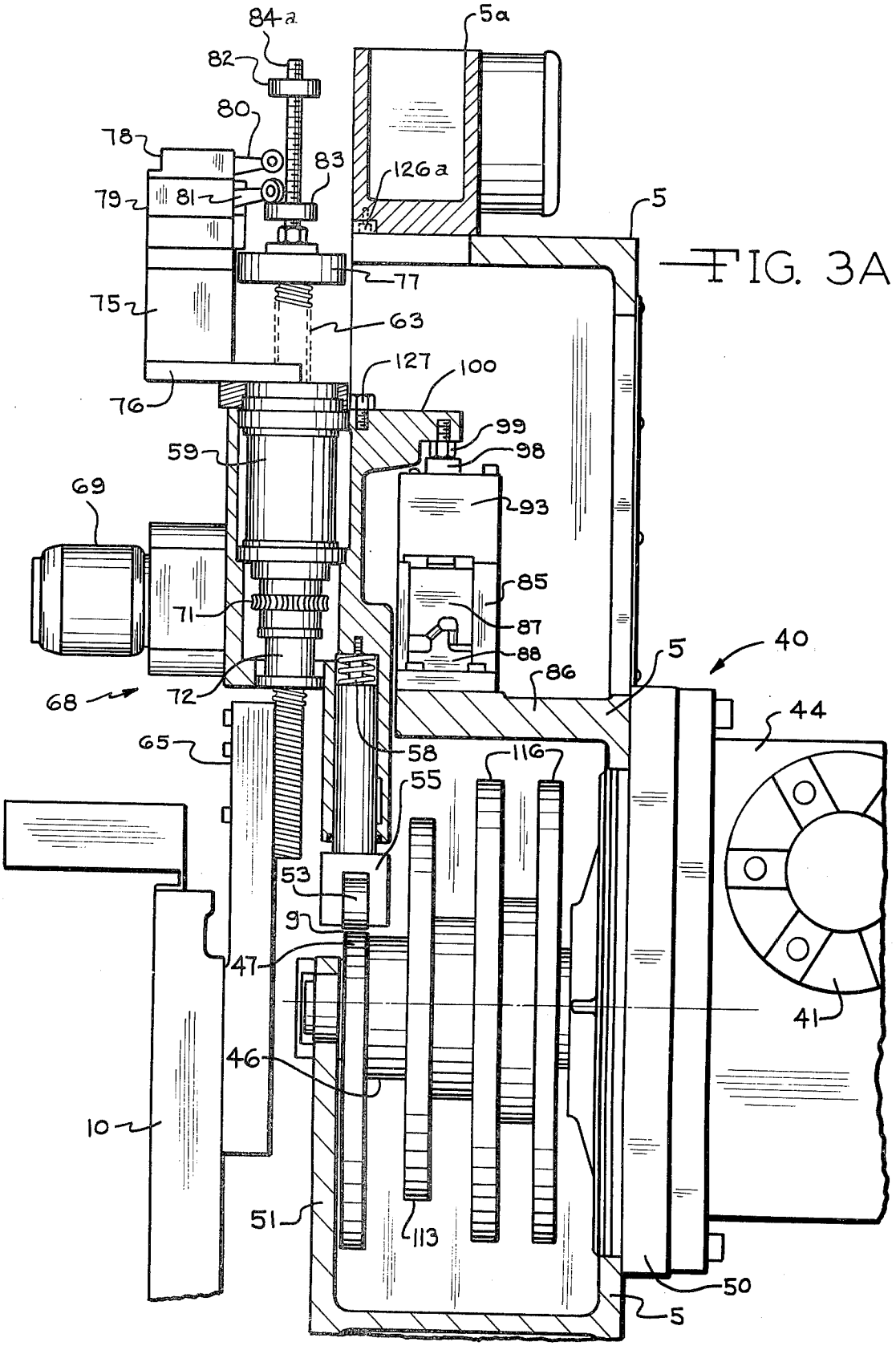
FIG. 3A is a view similar to FIG. 3, but illustrating the parts of the apparatus in another position of adjustment.

The main slide 7 and the compensator slide 10 are adapted to occupy an initial position in which the lower surfaces 15 of the grinding wheels 14 lie in a horizontal plane p-1, as shown in FIG. 1. In the initial position of the slides there is sufficient space between the chucks 4 and the grinding wheels 14 to enable the workpieces W to be fitted to and removed from the chucks. The slides 7 and 10 are adapted to be driven conjointly from the initial position shown in FIG. 1 to a second position in which the lower surfaces of the grinding wheels lie in a horizontal plane P-2 located a predetermined, fixed distance above the surfaces S of the workpieces. The drive means for effecting such movement of the slides is best illustrated in FIG. 3, 3A, and 7 and is designated generally by the reference character 40.

The drive means 40 comprises a variable speed electric motor 41 having an output shaft 42 to which is fixed a worm 43. The worm drives a gear reduction unit 44 the output of which is connected to a gear 45 that is fixed on a camshaft 46. Fixed on the camshaft is a plurality of cams one of which comprises a driving cam 47 for the main slide 7. As is best shown in FIG. 3, the camshaft 46 is journaled for rotation about an axis *a* in bearing assemblies 48 and 49 supported by frame members 50 and 51 forming part of the structure of the block 5.

Adjustable drive transmitting means 52 (FIGS. 3, 3A) couples the drive means 40 to the slides 7 and 10 and comprises a cam follower 53 that engages the periphery of the main slide drive cam 47 and is journaled on an axle 54 fixed at one end of a carrier 55 which is slidably accommodated in a socket 56 formed in the main slide 7. A headed bolt 57 extends through the carrier 55 and is threaded into an opening at the base of the socket 56 so as to prevent inadvertent removal of the carrier from the socket, but the carrier is capable of limited sliding movement within the socket to provide for lost motion between the slide 7 and the cam 47. A spring 58 is interposed between the base of the socket 56 and the adjacent end of the carrier 55 to provide lost motion for a purpose presently to explained.

The drive transmitting means 52 also includes relatively rotatable members including a housing 59 that is journaled by bearings 60 for rotation in an open ended chamber 61 formed in the slide 7. The bearing assemblies 60 permit rotation of the housing 59, but prevent movement of the latter axially of the chamber. Fixed within the housing 59 is a pair of conventional ball nuts 62 through which extends a non-rotatable shaft 63 having a helical thread or groove 64 extending over a major portion of its length. The ball nuts 62 contain recirculating balls (not shown) which are received in the groove 64, as is conventional. To the lower end of the shaft 63 is bolted or otherwise fixed a hanger arm

65 which, in turn, is bolted to the upper end of the compensator slide 10.

The construction and arrangement of the drive transmitting means 52 as thus far described are such that the slide 7 is supported on the periphery of the cam 47 via the follower roller 53. Thus, as the cam 47 rotates, the slide 7, and consequently the slide 10, will move vertically in accordance with changes in the contour of the periphery of the cam 47. The length of the path of vertical movement of the slides corresponds to the distance between the levels of the planes P-1 and P-2.

Means 68 is provided for adjusting the drive transmitting means 52 and comprises a reversible, electric stepping motor 69 of known construction coupled to a speed reduction unit 70 that is fixed to the main slide 7. The output of the unit 70 includes a worm (not shown) in mesh with a worm gear 71 which is keyed as at 72 (FIG. 3) to a sleeve 73 constituting an integral part of the housing 59 and encircling the shaft 63. Operation of the motor 69 in one direction or the other will effect conjoint rotation in a corresponding direction of the housing 59 and the ball nuts 62. Since the shaft 63 cannot rotate and since the housing 59 cannot move vertically, the rotation of the ball nuts 62 will effect longitudinal movement in one direction or the other of the shaft 63, depending upon the direction of rotation of the motor 69, so as to effect vertical adjustment of the compensator slide 10 relative to the main slide 7.

Fixed to the top of the main slide 7 and adjacent the shaft 63 is a bracket 75 having a plate 76 which straddles the shaft 63. At the upper end of the shaft 63 is a block 77 which functions as a safety stop 7 and which is engageable with the plate 76 so as to limit downward movement of the compensator slide 10 relative to the main slide 7. The bracket 75 also supports a pair of switch housings 78 and 79 within which are switches (not shown) connected in the circuit of the motor 69 and which are adapted to be operated by arms 80 and 81, respectively. The arms 80 and 81 are adapted to engage adjustable stops 82 and 83, respectively, which are threadedly mounted on a correspondingly threaded extension or rod 84*a* of the shaft 63. The purpose and operation of the parts 78 – 84 will be explained subsequently.

A grinding machine according to the invention includes feed means 84 (FIG. 3 and 4) for feeding the slides 7 and 10 conjointly, and consequently the grinding wheels 14, from the level of the plane P-2 toward and into engagement with the workpieces W and for returning the slides and grinding wheels to the level of the plane P-2 following a grinding operation. The feed means 84 comprises a channel-shaped base 85 that is fixed to a shelf 86 forming part of the block 5 and within which is mounted a horizontally reciprocable slide 87 and a guide 88. Between the slide 87 and the guide 88 are bearings 89. The slide 87 is slotted for the accommodation of a sine bar 90 which is fulcrumed at one end on a cylindrical bar 91 and which carries at its other end an adjusting screw 92 which bears against the slide 87. By manipulation of the screw 92 the sine bar 90 may be adjusted to any one of a number of different inclinations.

Overlying the base 85 and fixed thereto is a cover 93 within which is received a vertically adjustable carrier 94 having an axle 95 on which is journaled a wheel 96. The carrier 94 is constantly urged toward the sine bar 90 by a spring 97. The cover 93 has an opening through which projects an upstanding, movement interrupter leg 98 forming part of the carrier 94. The leg 98 lies in the path of vertical movement of a stop member 99 that is carried by a flange 100 of the main slide 7 and is operable to interrupt downward movement of the latter at the level of the plane P-2.

The feed means 84 is operated by the drive means 40 and is coupled to the latter by operating means 105 (FIG. 4). The operating means comprises a lever 106 that is pivoted between its ends by a stud 107 fixed on the block 5. At the upper end of the lever 106 is journaled a roller 108 which bears against a hardened stud 109 carried by the slide 87 and is maintained in snug engagement therewith by a keeper 110 that also is fixed to the slide 87. The opposite end of the lever 106 carries a rotatable cam follower 111 which is accommodated in a cam groove 112 formed in one face of a feed cam 113 that is fixed to the camshaft 46. The contour of the cam groove 112 is such that rotation of the feed cam 113 effects rocking movement of the lever 106 which, in turn, effects reciprocation of the slide 87 between the full line and chain line positions shown in FIG. 4. The effect of such reciprocation of the slide 87 will be explained hereinafter.

Dressing tool operating means 115 (FIGS. 2 and 6) for effecting joint operation of the dressing tools 22 in the manner previously described comprises a pair of confronting cams 116 fixed on the camshaft 46, the cams having identical cam grooves 118 (FIG. 3), formed in their confronting surfaces. The slide bar 34 for the right-hand dressing tool 22, as viewed in FIG. 2, carries at its free end a rotatable follower 120 which is accommodated in the groove 118 of one cam 116 and the slide bar 34 associated with the left-hand dressing tool carries at its free end a similar follower 121 that is accommodated in the groove 118 of the other cam 116. The slide bars 34 for the left-hand and right-hand dressing tools extend on opposite sides of the axis of rotation of the camshaft 46. Consequently, the contours of the cam grooves 118, although identical, are 180° out of phase with one another. Thus, upon rotation of the cams 116, the dressing tool holders 21 will be rocked simultaneously, but in different directions.

Apparatus for controlling the operation of the moving parts of the machine is designated generally by the reference character 124 (FIGS. 2 and 7) and comprises a housing 125 into which extends a rotary camshaft 126 that is adjustably coupled by a known coupler 127 to the camshaft 46. Mounted in the housing 125 is a number of limit switches S-1 to S-5, diagrammatically indicated in FIG. 2, which are adapted to be opened and closed by cams (not shown) mounted on the shaft 126. The control apparatus 124 is conventional and may correspond to any one of a number of rotating cam limit switch assemblies such as are manufactured by Gemco Electric Company, Clawson, Mich.

The control apparatus 124 in the disclosed embodiment utilizes a housing 125 having five limit switches S-1 to S-5 and a corresponding number of operating cams. The switch S-1 is connected to the motors for the workpiece spindles 3 so as to start and stop their rotation, and switches S-2 to S-5 are connected in the circuit of the drive motor 41. The control means 124 also includes within the housing 125 an adjustment wheel 128 which enables relative rotation of the camshaft 126 and the camshaft 46 so as to permit the switch operating cams to be synchronized with the cams on the camshaft 46.

To condition the apparatus for operation the camshaft 46 will be provided with a set of cams appropriate to the workpieces to be ground, the grinding wheel spindles 13 will be equipped with appropriate grinding wheels 14, the compensator slide 10 will be adjusted relatively to the main slide 7 so that the compensator slide, together with the grinding wheels supported thereby, initially is located at a selected distance above the surfaces S of the workpieces W to be ground. The initial position of the slide 7 is fixed by the engagement of stops 126*a* and 127*a* (FIG. 3) carried by the header 5*a* and the flange 100, respectively. The maximum radius of the cam 47 is somewhat in excess of the actual distance between the axis of rotation *a* of the cam and the stop 126*a*, but such excess is compensated for by compression of the spring 58 and consequent lost motion between the follower 53 and the slide 7. The initial position of the slide 10 is determined by adjustment of the stop 83 along the threaded rod 84*a* so as to engage the switch arm 81.

Following location of the slides in the initial position, the stop 82 will be adjusted so that it will engage the switch actuating arm 80 when the grinding wheels 14 have been eroded to the point where they should be replaced. The inclination of the sine bar 90 also will be adjusted so as to enable the slides 7 and 10 to move conjointly from the level of the plane P-2 toward the workpieces a distance sufficient to permit the grinding wheels to engage and effect the proper grinding of the workpieces.

Figure 8:
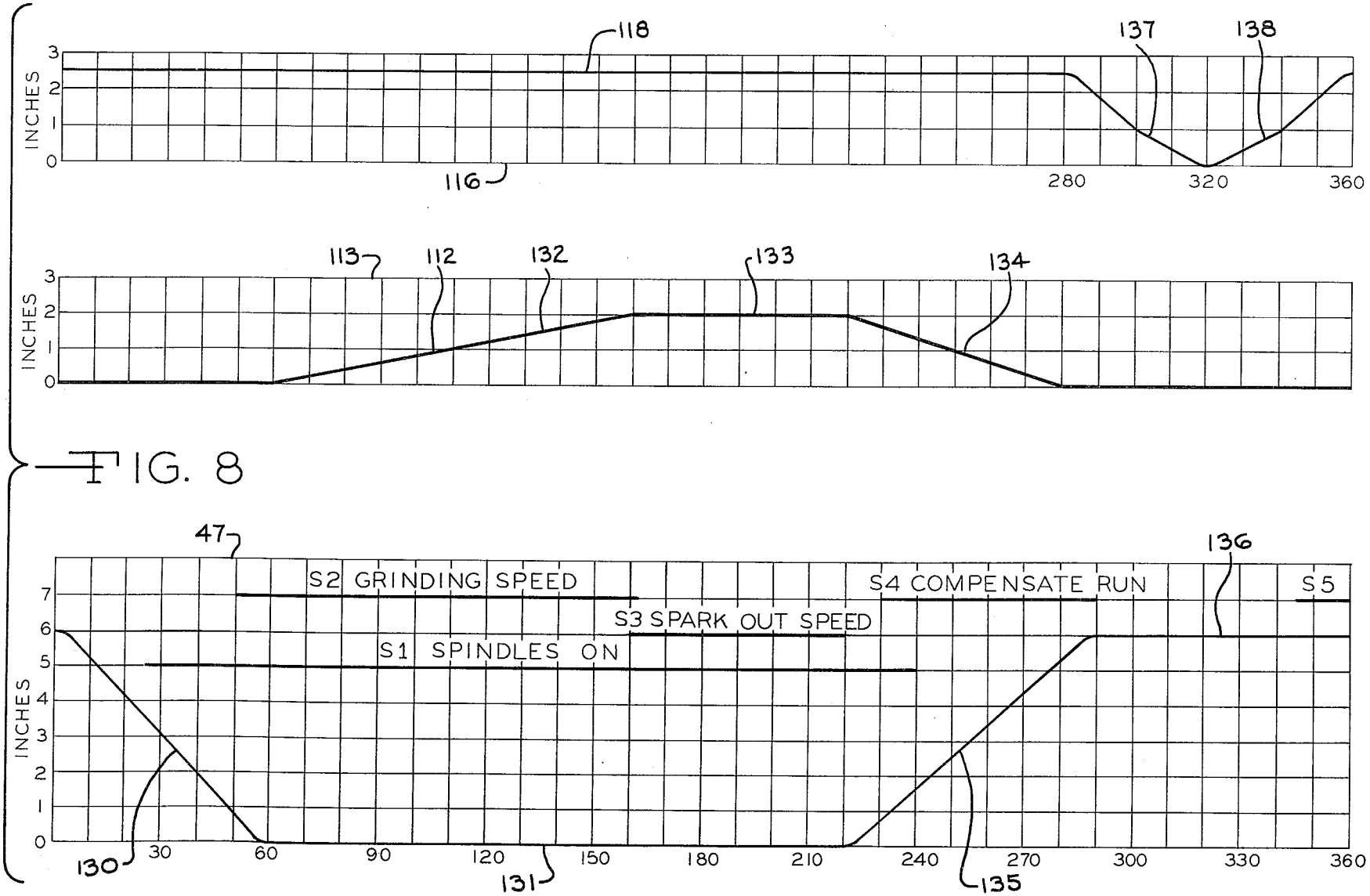
FIG. 8 is a diagram illustrating the timing cycle of the several cams incorporated in the machine.

Following the foregoing conditioning operations the motors 12 may be started so as to rotate the grinding wheels continuously. Workpieces W then may be mounted in the chucks 4 in preparation for a grinding cycle which will be described with reference to the timing diagrams shown in FIG. 8.

The grinding cycle is commenced by starting of the drive motor 41. The drive motor is started by closing of a switch (not shown). Operation of the motor 41 will effect rotation of the camshaft 46 and the cams mounted thereon. As the driving cam 47 commences to rotate the cam follower 53 will follow a relatively steep contour 130 (FIG. 8) of the cam 47 so as to lower the slides 7 and 10 conjointly at a relatively rapid pace a distance corresponding to the spacing between the planes P-1 and P-2. As is indicated in the timing diagram, movement of the slides 7 and 10 to the level of the plane P-2 requires about 60° of rotation of the cam 47. When the camshaft 46 has rotated through about 25 degrees, the switch S-1 will close so as to commence rotation of the workpiece spindles 3 and the workpiece W carried thereby. When the slides reach the level of the plane P-2, following about 60° rotation of the camshaft 46, the switch S-2 will be closed so as to effect rotation of the camshaft 46 at a speed corresponding to the rate at which the grinding wheels are to be fed to the workpieces.

When the slides 7 and 10 have been lowered to the level of the plane P-2, the leg 98 of the feed means 84 will be engaged by the stop 99 so as to interrupt further downward movement of the slide 7. The cam 47 has a dwell contour 131 on its periphery the radius of which is less than the distance from the axis *a* of the cam to the follower 53 so as to provide a gap *g* (FIG. 3A) between the latter and the cam 47. The slide 7, therefore, and consequently the slide 10, is supported solely by the engagement of the stop 99 with the leg 98 at the level of the plane P-2. Upon continued rotation of the camshaft 46 through 60°, a rise 132 in the cam groove 112 of the feed cam 113 commences clockwise rocking of the lever 106 (as viewed in FIG. 4) so as to effect movement of the slide 87 to the right. As the slide 87 moves to the right, the inclined surface of the sine bar 90 removes the support for the flange 100 of the slide 7, thereby enabling further downward movement of the slides 7 and 10 as permitted by the gap *g* and thus effect movement of the grinding wheels 14 from the level of the plane P-2 toward and into engagement with the workpieces W. The actual vertical distance traversed by the slides 7 and 10 as a result of operation of the feed means 84 depends upon the length of the stroke of the slide 87 and the inclination of the sine bar 90. In the disclosed embodiment as shown by the timing diagram for the feed cam 113 in FIG. 8, the stroke length of the slide 87 is about two inches. A typical inclination of the sine bar 90 may be such that, for a stroke of two inches of the slide 87, the vertical movement of the slide 7 may be about 0.020 inch, but such distance may be varied by adjustment of the adjusting screw 92.

By the time the camshaft 46 has rotated through about 160°, the groove 112 in the feed cam 113 forms a dwell surface 133 so as to maintain the grinding wheels 14 at a fixed level and in engagement with the workpieces W. At about this time the switch S-3 also will be closed so to effect rotation of the camshaft 46 at a relatively slow spark-out speed.

Continued rotation of the camshaft 46 through 220° causes the switch S-3 to open, whereupon the rotation of the camshaft 46 resumes its normal speed. Simultaneously, the groove 112 in the cam 113 forms a surface 134 which acts on the feed lever 106 to return the slide 87 toward the position shown in FIG. 4, thereby enabling the sine bar 90 to raise the slides 7 and 10 conjointly to the level of the plane P-2. The cam surface 134 is steeper than the cam surface 132. Consequently, return movement of the slides away from the workpieces toward the level of the plane P-2 occurs more quickly than does the movement of the slides from that level toward the workpieces.

By the time the camshaft 46 has rotated through 220°, a return surface 135 on the cam 47 effects simultaneous movement of the slides 7 and 10 toward their original position as determined by a dwell surface 136 on the cam 47.

After the slides commence their movement away from the workpieces, and preferably after about 240° of rotation of the camshaft 46, the switch S-1 is opened. The rotation of the workpiece spindles then stop enabling fresh workpieces to be substituted for those which have been ground.

Shortly after the slides 7 and 10 commence their movement away from the workpieces, the switch S-4 is operated so as to deliver a series of pulses to the adjusting motor 69 and effect rotation of the latter in such direction as to cause relative rotation of the housing 59 and the grooved shaft 63 in such direction as to lower the slide 10 relatively to the slide 7. In the timing diagram disclosed in FIG. 8, the switch S-4 is closed when the camshaft 46 has rotated through 230° and remains closed until the camshaft is rotated through 300°, but the time during which the switch S-4 is closed may be varied by changing the cam which actuates the switch S-4. The switch S-4 should remain closed for a period of time necessary to enable operation of the adjusting motor 69 for a period long enough to cause the slide 10 to move downwardly relatively to the slide 7 a distance slightly greater than the thickness of the material that has been eroded from the grinding wheels 14 as a result of their grinding operation. As a consequence, once the slide 7 has been returned to its initial position in which the stops 126*a* and 127*a* are engaged, and is maintained in that position by a dwell surface 136 on the cam 47, the slide 10 will be in an adjusted position in which the lower surfaces 15 of the grinding wheels 14 will lie in a plane slightly below the level of the plane P-1.

When the camshaft 46 has rotated through about 280°, i.e., prior to the full return of the slide 7 to its initial position, the grooves 118 in the dresser cams 116 have rise surfaces 137 which act on the respective slides 34 to commence swinging of the dressing tool holders 21 toward their associated grinding wheels 14. By the time the camshaft 46 has approached 320° of rotation, the downward adjustment of the compensator slide 10 will have been completed and the main slide 7 will have been returned to its initial position. By this time the rise surfaces 137 of the dresser cam grooves 118 will have caused the dresser tool holders 21 to traverse the radial width of the grinding wheels 14, whereupon a return surface 138 of the cam grooves 118 acts on the respective slide bars 34 to swing the tool holders 21 back to their initial positions, thus causing the dressing tools 22 to retraverse the grinding wheels and dress their surfaces at a level corresponding to that of the plane P-1.

By the time the camshaft 46 has rotated through about 345°, the switch S-5 will close so as to condition the machine for another cycle of operation.

The foregoing operation of the machine is repetitive. Thus, after each grinding operation, the main slide 7 is returned to its initial or original position, but the compensator slide 10 is adjusted downwardly relatively to the main slide 7 and the grinding wheels 14 are dressed so that, at the beginning of each new cycle of operation, the lower surfaces 15 of the grinding wheels 14 are at the same distance above the surfaces S of the workpieces to be ground, even though the slide 10 itself is at a lower level.

Each time the slide 10 is adjusted downwardly, the stop 82 at the upper end of the rod 84 is moved closer to the switch operating arm 80. Eventually the stop 82 will engage the operating arm 80, thereby operating the switch within the housing 78. This switch is connected in the circuit of the adjusting motor 69 in such manner as to effect continuous rotation of the latter in a direction to raise the slide 10 relatively to the slide 7 until such time as the stop 83 engages the operating arm 81 for the switch in the casing 79. This switch also is connected in the circuit of the motor 69 so that, upon engagement of the arm 81 by the stop 83, the reverse rotation of the motor 69 will cease. The upward movement of the slide 10 will signal the need for replacing the worn wheels 14 with new ones corresponding to the original wheels.

The continuous operation of the adjusting motor 69 in a direction to move the compensator slide 10 upwardly relatively to the slide 7 is advantageous since it constitutes, in effect, a rapid return of the slide 10 to a precise initial position, as determined by the stop 83, in which fresh grinding wheels may be substituted for worn wheels. The precise positioning of the compensator slide 10 makes it unnecessary to perform time-consuming set-up or adjustment operations each time worn grinding wheels are replaced.

The disclosed embodiment is representative of a presently preferred form of the invention, but is intended to be illustrative rather than definitive thereof. The invention is defined in the claims:

I claim:

1. A grinding machine construction comprising a frame; workpiece supporting means carried by said frame; a first slide; means guiding said first slide for reciprocating movements along a path between first and second positions remote from and adjacent said workpiece supporting means, respectively; drive means coupled to said first slide for reciprocating the latter; a second slide; grinding means carried by said second slide and having a surface engageable with a workpiece supported by said workpiece supporting means; adjustable means coupling said first and second slides for reciprocating the latter conjointly with said first slide between a first position remote from said workpiece supporting means to a second position adjacent said workpiece supporting means and in which second position said surface of said grinding means is at a predetermined distance from said workpiece supporting means; and means for adjusting said adjustable means to effect movement of said second slide relative to said first slide in a direction toward said workpiece supporting means an amount to compensate for wear of said grinding means and thereby maintain said predetermined distance constant regardless of wear of said grinding means.

2. A machine tool construction comprising frame means; workpiece supporting means carried by said frame means; slide means carried by said frame means for movement toward said workpiece supporting means from a first position spaced from said workpiece supporting means to a second position less spaced from said workpiece supporting means, and return; tool support means; means mounting said tool support means on said slide means for movements with the latter and for movements relative to said slide means toward and away from said workpiece supporting means; movable means carried by said frame means in the path of movement of said slide means in a direction toward said workpiece supporting means for interrupting such movement of said slide means when it reaches said second position; drive means for moving said slide means between said positions; and means coupling said drive means and said movable interrupting means for moving the latter in a direction to enable further movement of said slide means toward said workpiece supporting means from said second position.

3. A construction according to claim 2 including operating means coupled to said tool support means for moving the latter relative to said slide means toward and away from said workpiece supporting means.

4. A construction according to claim 2 including operating means coupled to said tool support means for moving the latter toward said workpiece supporting means in successive increments relative to said slide means.

5. A construction according to claim 4 including means coupling said drive means to said operating means for operating the latter.

6. A construction according to claim 5 wherein the means coupling said drive means to said operating means is operative during the return of said slide means toward said first position.

7. A construction according to claim 2 including means for treating a tool mounted on said tool support means; and means mounting said treating means on said frame means for movements into and out of engagement with such tool.

8. A construction according to claim 7 including means coupling said drive means and said tool treating means for moving the latter.

9. A construction according to claim 2 wherein said drive means includes a rotatable cam and cam follower means carried by said slide and engageable with said cam.

10. A construction according to claim 2 wherein said tool support mounting means comprises relatively rotatable members; and operating means coupling said drive means and said members for effecting relative rotation thereof.

11. A grinding machine construction comprising frame means; workpiece supporting means carried by said frame means; slide means; support means for a tool composed of erodable material; means mounting said support means on said slide means for movements with the latter in a direction toward said workpiece supporting means and for movements relative to said slide means in said direction; means mounting said slide means on said frame means for movement in said direction from a first position in which a surface of said tool is spaced from said workpiece supporting means to a second position in which said surface is less spaced from said workpiece supporting means and is located a predetermined distance from a workpiece supported by said workpiece supporting means; drive means; drive transmitting means coupling said drive means and said slide means for moving the latter between said positions; operating means for moving said tool support means relative to said slide means toward said workpiece support means; and means for operating said operating means to vary the location of said tool support means by an amount such that said predetermined distance is substantially constant regardless of erosion of the surface of such grinding wheel.

12. A construction according to claim 11 including feed means for feeding said slide means from said second position toward said workpiece supporting means, and means coupling said drive means to said feed means for operating the latter.

13. A construction according to claim 12 wherein said feed means comprises an adjustable sine bar.

14. A construction according to claim 11 including tool dressing means, means mounting said dressing means on said frame means for movements in directions toward and away from a tool supported on said tool support means, and means for moving said dressing means in timed relation to the movement of said tool support means to enable dressing of such tool.

15. A construction according to claim 14 including means coupling said drive means to the means for moving said dressing means.

16. A construction according to claim 11 wherein said operating means includes relatively rotatable members and wherein the means for operating said operating means is connected to one of said members for effecting relative rotation of said members.

17. A machine tool construction comprising a frame; means carried by said frame for supporting a workpiece; a first slide mounted on said frame for reciprocating movements in directions toward and away from said workpiece supporting means; a second slide for supporting a tool adapted to engage a workpiece supported by said workpiece supporting means; means mounting said second slide for movements with said first slide and for adjustment in said directions relative to said first slide; means for adjusting said second slide relative to said first slide; drive means; drive transmitting means coupling said drive means to said first slide for reciprocating the latter; and means coupling said adjusting means and said drive means for operating said adjusting means in timed relation to the movements of said first slide.

18. A construction according to claim 17 wherein said mounting means comprises relatively rotatable members operable in one direction of relative rotation to move said second slide in one direction relative to said first slide and operable in the opposite direction of relative rotation to move said second slide in the opposite direction relative to said first slide.

19. A construction set forth in claim 18 wherein one of said members is fixed to said second slide and the other of said members is rotatably supported by said first slide.

* * * * *